US007969081B2

(12) United States Patent
Kosugi et al.

(10) Patent No.: US 7,969,081 B2
(45) Date of Patent: Jun. 28, 2011

(54) PLASMA DISPLAY PANEL

(75) Inventors: Naoki Kosugi, Kyoto (JP); Yukihiro Morita, Osaka (JP); Masanori Miura, Osaka (JP); Shinichiro Hashimoto, Osaka (JP); Yoshio Watanabe, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1062 days.

(21) Appl. No.: 11/791,724

(22) PCT Filed: Sep. 7, 2006

(86) PCT No.: PCT/JP2006/317760

§ 371 (c)(1),
(2), (4) Date: May 29, 2007

(87) PCT Pub. No.: WO2007/029779

PCT Pub. Date: Mar. 15, 2007

(65) Prior Publication Data

US 2008/0165086 A1 Jul. 10, 2008

(30) Foreign Application Priority Data

Sep. 9, 2005 (JP) ..... 2005-261549

(51) Int. Cl.
*H01J 17/49* (2006.01)
*G09G 3/28* (2006.01)

(52) U.S. Cl. ..... 313/386; 313/581; 313/582; 313/584; 313/631; 345/60; 345/67

(58) Field of Classification Search ..... 313/238, 313/292, 293, 296, 301, 567, 581, 582, 584, 313/631, 586; 315/169.1, 169.4; 345/60, 345/67

See application file for complete search history.

(56) References Cited

U.S. PATENT DOCUMENTS

| | | | | |
|---|---|---|---|---|
| 6,376,995 | B1 * | 4/2002 | Kato et al. | 315/169.3 |
| 6,380,678 | B1 | 4/2002 | Kim | |
| 6,534,915 | B2 * | 3/2003 | Amemiya | 313/586 |
| 6,608,447 | B2 * | 8/2003 | Ahn | 315/169.1 |
| 6,833,673 | B2 | 12/2004 | Toyoda et al. | |
| 7,227,513 | B2 * | 6/2007 | Lee et al. | 345/60 |
| 7,239,086 | B2 * | 7/2007 | Yuki et al. | 313/586 |
| 7,315,123 | B2 | 1/2008 | Hur et al. | |
| 2002/0005822 | A1 * | 1/2002 | Lee et al. | 345/60 |
| 2003/0141817 | A1 | 7/2003 | Shinoda et al. | |
| 2005/0106984 | A1 | 5/2005 | Shinoda et al. | |
| 2006/0033448 | A1 | 2/2006 | Hur et al. | |
| 2006/0152159 | A1 | 7/2006 | Yoo | |

(Continued)

FOREIGN PATENT DOCUMENTS

| | | |
|---|---|---|
| JP | 5-12991 | 1/1993 |

(Continued)

*Primary Examiner* — My-Chau T Tran

(74) *Attorney, Agent, or Firm* — Wenderoth, Lind & Ponack, L.L.P.

(57) ABSTRACT

A plasma display panel includes: pairs of electrodes having first electrode and second electrode which are arranged in parallel with each other; first substrate having dielectric layer formed so that the dielectric layer can cover the pairs of electrodes; and second substrate having third electrode which is arranged crossing the pairs of electrodes, and the plasma display panel further includes: floating electrodes, protruding onto a discharge space provided on dielectric layer at positions respectively corresponding to first electrode and second electrode, wherein floating electrodes are opposed to each other. Due to the above composition, the discharge starting voltage is reduced and the drive voltage is decreased. Accordingly, the light emitting efficiency is enhanced.

4 Claims, 5 Drawing Sheets

U.S. PATENT DOCUMENTS

| | | | | |
|---|---|---|---|---|
| 2006/0175974 | A1* | 8/2006 | Hur et al. | 313/631 |
| 2006/0226780 | A1* | 10/2006 | Kwon et al. | 313/586 |

FOREIGN PATENT DOCUMENTS

| | | |
|---|---|---|
| JP | 9-330668 | 12/1997 |
| JP | 11-273573 | 10/1999 |
| JP | 2000-188063 | 7/2000 |
| JP | 2000-251745 | 9/2000 |
| JP | 2001-60433 | 3/2001 |
| JP | 2003-132804 | 5/2003 |
| JP | 2003-151449 | 5/2003 |
| JP | 2003-223851 | 8/2003 |
| JP | 2003-272534 | 9/2003 |
| JP | 2006-19257 | 1/2006 |
| JP | 2006-196438 | 7/2006 |
| WO | 00/17846 | 3/2000 |

* cited by examiner

PLASMA DISPLAY PANEL

This Application is a U.S. National Phase Application of PCT International Application PCT/JP2006/317760.

TECHNICAL FIELD

The present invention is related to a plasma display panel on which emission from gas discharge is utilized.

BACKGROUND ART

As a flat display device in which emission from gas discharge is utilized, a plasma display panel, which will be referred to as PDP hereinafter, has been conventionally come into the market. Concerning PDP, two types are provided. One is a DC type and the other is an AC type. As a large display device, a face discharge type AC type PDP has a higher technical potential and provides long life. Therefore, the face discharge type AC type PDP has been put on the market.

FIG. 7 is a sectional view showing a structure of a discharge cell of a conventional face discharge type AC type plasma display panel. As shown in FIG. 7, on first substrate 1 which is a front plate of the discharge cell, a pair of transparent electrodes (not shown) are formed on a surface of glass substrate 2 while discharge gap g1 of about 80 μm is being interposed between the pair of transparent electrodes. Bus electrodes (not shown), which are formed out of metallic electrodes so as to reduce electric resistance, are respectively formed on the pair of transparent electrodes. In this way, a plurality of pairs of display electrodes 5 are formed which includes first electrode 3, which is a scanning electrode, and also includes second electrode 4 which is a maintaining electrode. Dielectric material layer 6 and protective film 7 are successively laminated to cover the pair of electrodes. Dielectric material layer 6 is made of glass, the melting point of which is low. Dielectric material layer 6 has an electric current limiting function which is peculiar to AC type PDP. Protective film 7 protects surfaces of the above pair of electrodes and effectively emits secondary electrons so that the discharge starting voltage can be lowered. Concerning the material of protective film 7, metallic oxide MgO (magnesium oxide) is widely used which is an optically transparent electric insulating material, the secondary electron emission coefficient γ of which is high and further the spattering resistance of which is high.

On the other hand, on glass substrate 9 of second substrate 8 which is a back plate, third electrode 10, which is a data electrode for writing down image data, is formed in a direction perpendicular to the direction of display electrode 5 of first substrate 1. Further, dielectric layer 11 on the back side is formed out of glass, the melting point of which is low, so that at least portions of the surfaces of third electrode 10 and glass substrate 9 can be covered. On dielectric material layer 11 in a boundary with an adjoining discharge cell (not shown), bulkhead 12, the height of which is predetermined, is formed out of glass, the melting point of which is low, for example, into a pattern shape, such as a stripe shape or a parallel cross shape. Further, on a surface of dielectric material layer 11 and on a side of bulkhead 12, fluorescent material layer 13 is formed. On fluorescent material layer 13, fluorescent materials of emitting three colors of red, green and blue are formed in the corresponding discharge cells.

Worked faces of first substrate 1 of the front plate and second substrate 8 of the back plate are opposed to each other. First electrode 3 and second electrode 4 are arranged so that they can cross third electrode 10 while making a right angle with third electrode 10. In this way, these components are tightly sealed on the panel. After the atmosphere and impure gas are discharged from the panel, Xe (xenon) mixed gas such as xenon.neon or xenon.helium, which is rare gas, is charged and sealed on the panel as discharging gas by the pressure of several tens kPa.

On the plasma display panel on which a plurality of discharge cells are arranged being formed into a matrix, a drive circuit for driving like a matrix and a control circuit for controlling the drive circuit are provided. In this way, the plasma display device is composed.

In the conventional PDP shown in FIG. 7, the maintaining discharge, which is a primary discharge for ensuring the luminance, is "a face discharge" generated between first electrode 3 of the scanning electrode and second electrode 4 of the maintaining electrode which are an anode and cathode formed substantially parallel with the surface of glass substrate 2. That is, an angle, which is formed between an electric line of force in the discharge space and the surface of protective layer 7 contributing to discharge, is extended to be large length. Accordingly, a loss of charged particles and excited particles at the time of discharging is increased. Accordingly, the discharge starting voltage becomes necessarily higher than "the opposition discharge voltage" at the time of the same discharge gap. In this case, "the opposition discharge" is defined as a discharge in which an angle formed between the electric line of force in the discharge space and the electrode face contributing to discharge is small. Since the discharge is PDP of a narrow gap length in which the discharge gap is small, discharge region 14 is small. Therefore, the light emission efficiency is low and it is difficult to increase the luminance.

In order to solve the above conventional problems, Japanese Patent Application No. 2000-571429 discloses the following PDP of high luminance. When the discharge gap formed by the display electrode including the first and the second electrode is made long, the discharge region is extended to be larger than that of the conventional discharge region. Therefore, the light emission efficiency is enhanced by 1.5 times.

FIG. 8 is a sectional view showing a structure of another example of a discharge cell of a conventional face discharge type AC type plasma display panel. Like reference numerals are used to indicate like parts in FIGS. 7 and 8.

As shown in FIG. 8, display electrode 15 of first substrate 1, which is a front plate of the discharge cell, is arranged on a surface of glass substrate 2 in such a manner that, for example, while discharge gap g2, which is a long gap of 200 to 300 μm length, is being interposed between first electrode 16 and second electrode 17, which are formed out of metallic electrodes, when first electrode 16 and second electrode 17 are formed by a narrow width.

When display electrode 15, the discharge gap of which is formed to be long, is provided in this way, first, discharge is generated in the longitudinal direction between first electrode 16 and third electrode 10 which is a data electrode, because an interval between first electrode 16 and third electrode 10 is small. Next, face discharge is generated between first electrode 16 and second electrode 17 having a long gap upon which high maintaining discharge voltage of about 300 V is impressed. Due to the foregoing, the discharge region is extended and the light emission efficiency is enhanced and the luminance is increased high.

However, the discharge starting voltage of PDP of the above long gap becomes higher than the discharge starting voltage of the conventional PDP of the narrow gap described before. The reason why the drive voltage is increased is described below. In the same manner as that of the narrow gap PDP, even in PDP of a long gap, an electric line of force, which is generated between the electrodes arranged in parallel with the substrate face, obliquely comes out from the electrode face. Therefore, the discharge form is "a face discharge". Since the gap length is increased, the discharge staring voltage is necessarily raised as compared with the discharge starting voltage of PDP of a narrow gap.

In order to solve the above problems, for example, the official gazette of Japanese Patent Unexamined Publication No. 2003-132804 discloses the following technique. When a display electrode is formed on a face of a side portion of a bulkhead, a principal plane contributing to discharge on the display electrode is made to cross with the substrate face while making a substantially right angle. An opposition discharge, which is generated between a principal plane of the adjoining electrode and a principal plane which is arranged being opposed to the principal plane of the adjoining electrode via a discharge space, is made to be a maintaining discharge. Due to the foregoing, the discharge region is extended and the light emission efficiency is enhanced. The discharge form of this example is an opposition discharge between electrodes interposing the discharge gas space. In this case, an electric charge movement direction is not a direction of the panel thickness but a direction along the substrate face. This discharge form is referred to as "a face direction opposition discharge".

When an electric power supply portion formed out of a conductive film provided on the display electrode is formed on a surface of the side of the bulkhead formed on the front face plate, a principal plane contributing to discharge from the display electrode is made to cross with the substrate face while making a substantially right angle and arranged being opposed to the principal plane of the adjoining display electrode while interposing a gas space. Further, on the front plate, in order to cause pilot light discharge, a pair of auxiliary electrodes are provided between the pair of display electrodes.

In the conventional face discharge type AC type PDP, the gap of which is narrow, the maintaining discharge is a face discharge. Therefore, a great loss is caused in the discharge and the discharge starting voltage is raised. Further, due to the narrow gap, the discharge region is small. Therefore, the light emission efficiency is low and it is difficult to enhance the luminance.

When it is made to be an AC type PDP, the gap of which is long, the light emission efficiency is enhanced and the high luminance can be obtained. However, in the same manner as that described above, the maintaining discharge becomes a face discharge. Therefore, the discharge starting voltage is raised. When the gap is extended long, it becomes necessary to provide a higher maintaining discharge voltage of about 300 V. Since the drive voltage is raised, a peak value of the discharge electric current is increased. Especially, in the case of a large image plane panel, it is difficult to sufficiently supply a sharp and high peak electric current. Accordingly, a state of discharge in each discharge cell greatly depends upon a lighting area of the panel. Accordingly, a large image plane driving display becomes not uniform.

On the other hand, in the case where a discharge region is extended by making the maintaining discharge, which is conducted between the display electrodes, to be a face direction opposition discharge when an electric power supply portion of the display electrode is formed on a surface of the side of the bulkhead formed on the front plate, the opposition discharge is conducted, so that the discharge region can be extended and the light emission efficiency can be enhanced. However, since an auxiliary electrode is provided in addition to the display electrode in this case, the opening ratio is deteriorated and the luminance is lowered. Further, this structure is complicated in such a manner that a bulkhead is formed on the front plate and an electric power supply portion, which is extended from the display electrode, is formed on a surface of the bulkhead side portion as a principal plane of the display electrode and opposed. Therefore, it is difficult to manufacture the device and the manufacturing cost is raised.

DISCLOSURE OF THE INVENTION

It is an object of the present invention to provide PDP of a simple electrode structure, the luminance of which is enhanced by improving the light emission efficiency when the discharge region is extended by making the discharge form into an opposition discharge form and when the discharge starting voltage is lowered so as to reduce the drive voltage by suppressing a loss of the loading particles and exciting particles in discharge.

The present invention provides a plasma display panel including: a plurality of pairs of electrodes having a first electrode and a second electrode which are arranged in parallel with each other; a first substrate having a dielectric layer formed so that the dielectric layer can cover the plurality of pairs of electrodes; and a second substrate having a third electrode which is arranged crossing the pairs of electrodes, wherein a plurality of discharge cells are provided when the first substrate and the second substrate are arranged being opposed to each other, the plasma display panel further including: floating electrodes protruding onto a discharge space side provided on the dielectric layer at positions respectively corresponding to the first electrode and the second electrode, wherein the floating electrodes are opposed to each other.

According to the present invention, at positions on the dielectric layer corresponding to the pair of electrodes on the first substrate, floating electrodes are arranged being opposed to each other. Due to the above structure, it is possible to extend a discharge region by a simple electrode composition while the discharge form is being formed into an opposition discharge form. When a loss caused by the loading particles and the exciting particles at the time of discharge is suppressed, it is possible to reduce the discharge starting voltage so that the drive voltage can be decreased. Due to the foregoing, it becomes possible to provide a highly reliable PDP, the luminance of which is high, in which the light emission efficiency and the luminance are enhanced and it is possible to be driven by a low discharge current peak value.

DESCRIPTION OF REFERENCE NUMERALS AND SIGNS

Figure 1A:
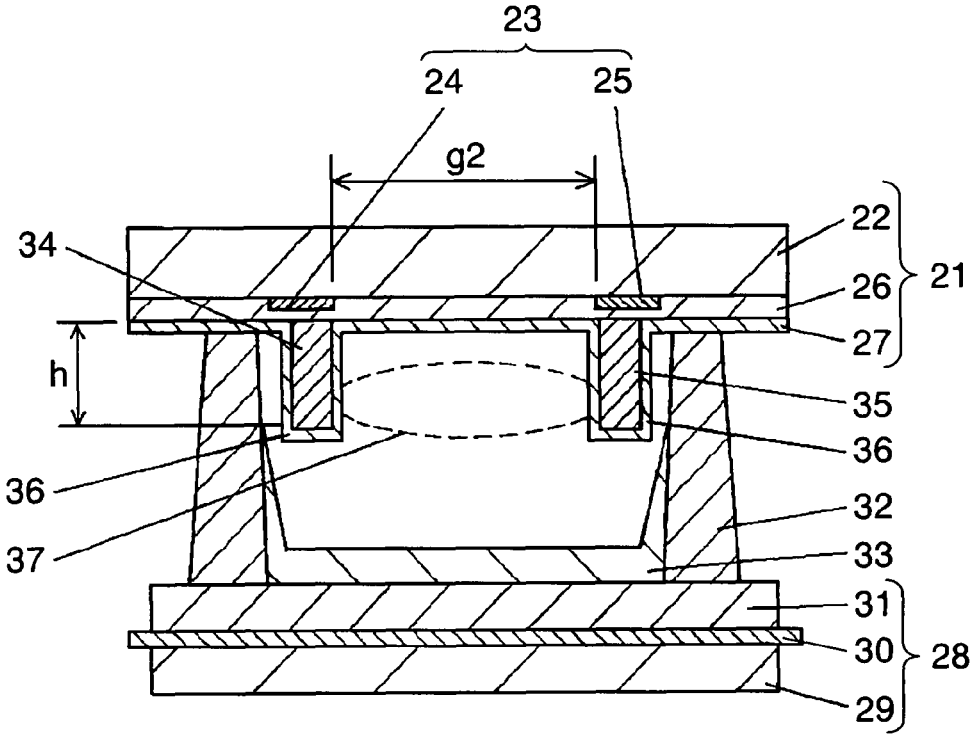
FIG. 1A is a sectional view showing a structure of a discharge cell on a plasma display panel of Embodiment 1 of the present invention.

21 First substrate
22, 29 Glass substrate
23 Display electrode
24 First electrode
25 Second electrode
26 Dielectric layer
27, 36 Protective film
30 Third electrode
32 Bulkhead
33 Fluorescent material layer
34, 34*a*, 35, 35*a* Floating electrode
38 Electrical conductive portion
39 Dielectric portion

PREFERRED EMBODIMENTS FOR CARRYING OUT THE INVENTION

Referring to FIGS. 1A to 6, PDP of one embodiment of the present invention will be explained below.

Embodiment 1

Figure 1B:
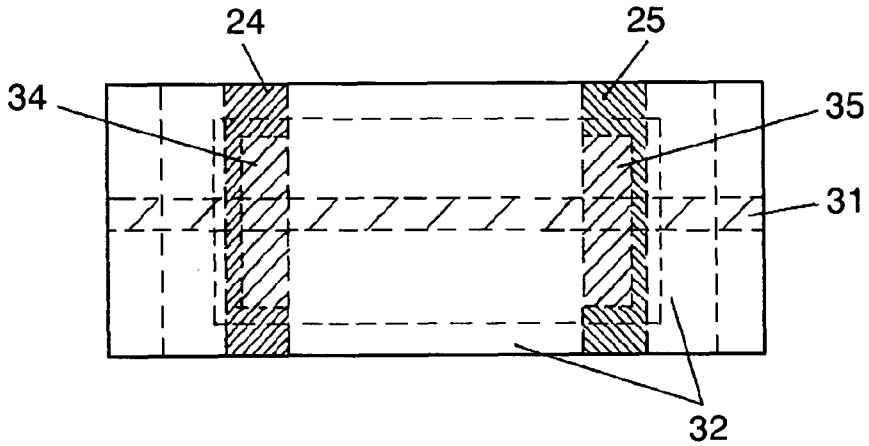
FIG. 1B is a plan view showing a structure of a discharge cell on a plasma display panel of Embodiment 1 of the present invention.

FIG. 1A is a sectional view showing a structure of a discharge cell on a plasma display panel of Embodiment 1 of the present invention. FIG. 1B is a plan view showing a structure of a discharge cell on a plasma display panel of Embodiment 1 of the present invention.

Although only one discharge cell is shown in FIGS. 1A and 1B, a large number of discharge cells emitting light of red, green and blue are arranged to compose PDP.

As shown in FIGS. 1A and 1B, in the discharge cell, on glass substrate 22 on first substrate 21 of a front plate, a pair of electrodes including first electrode 24, which is a scanning electrode, and second electrode 25, which is a maintaining electrode, are arranged in parallel with each other as a pair of electrodes which form display electrode 23.

A method of forming the electrode will be described below. In order to more easily supply electric power onto a surface of glass substrate 22, for example, paste of Ag (silver) is print-coated and baked by the thick film process. Due to the foregoing, a pair of bus electrodes formed out of metallic electrodes of narrow width of about 80 μm, the film thickness of which is several μm, the electric resistance of which is low, are formed being opposed to each other while the pair of bus electrodes are interposing long discharge gap g2, the length of which is 200 to 300 μm. In this way, first electrode 24 and second electrode 25, which form display electrode 23, are formed being arranged in a direction parallel with a direction perpendicular to the drawing surface. In this connection, a value of discharge gap g2 is not limited to the value in the above specific range. According to the size of PDP discharge cell to be designed, the value of discharge gap g2 may be appropriately decided. The display electrode is not limited to the above bus electrode of low resistance but a transparent electrode may be formed as the display electrode. The bus electrode is not limited to the above Ag electrode. Except for the Ag electrode, a laminated electrode may be used in which patterned films are laminated in the order of Cr (chrome), Cu (copper) and Cr. Alternatively, an electrode of Al (aluminum) may be used which is made by the thin film forming process. Concerning the bus electrode material, it is possible to use metal such as Ag, Al, Ni (nickel), Pt (platinum), Cr, Cu or Pd (palladium). Alternatively, it is possible to use materials of conductive ceramics such as carbide or nitride of metal. Alternatively, it is possible to use a combination of these materials. When necessary, it is possible to use a laminated electrode in which these materials are laminated on each other.

As shown in FIGS. 1A and 1B, dielectric layer 26, the film thickness of which is several μm to several tens μm, is made of lead glass of low melting point, non-lead glass of low melting point or material of $SiO_2$ so that surfaces of the pair of electrodes including first electrode 24 and second electrode 25 and a surface of glass substrate 22 can be covered with the dielectric layer 26.

On dielectric layer 26, protective film 27 is formed in such a manner that in order to reduce the discharge starting voltage, for example, metallic oxide containing MgO (magnesium oxide), the secondary electron emission coefficient γ of which is high, the spattering resistance of which is high for protecting the dielectric layer 26 from ion shock at the time of discharge, which is optically transparent, the electrical insulation of which is high, is formed by a film thickness of several thousand Å by the vacuum vapor deposition method or the electron beam vapor deposition method.

On the other hand, on an inner surface of glass substrate 29 on second substrate 28, third electrode 30, which is a data electrode, which is made of, for example, electrode material containing Ag, is formed being arranged in the lateral direction on the drawing surface so that third electrode 30 can make a substantially right angle with the pair of electrodes of first electrode 24 and second electrode 25 in each discharge cell.

On an inner face of the second substrate 28, dielectric layer 31 on the back plate side, which is made of lead glass or non-lead glass of low melting point or $SiO_2$ material, is formed so that dielectric layer 31 can cover surfaces of third electrode 30 and glass substrate 29.

On this dielectric layer 31, bulkhead 32 is formed by a pattern of projected parallels. The bulkhead 32 is formed as follows. After glass material paste of low melting point has been coated on dielectric layer 31, so that a boundary region with the adjoining discharge cell can be partitioned, that is, by a projected parallels pattern for partitioning an arrangement of the discharge cells in the directions of line and row, the bulkhead 32 is formed by the sand blast method or the photolithography method.

Between bulkheads 32, fluorescent material layers 33 of red, green and blue are formed when the fluorescent material paste is print-coated and baked. Concerning this fluorescent material layer 33, $(Y,Gd)BO_3$:Eu is used for red, $Zn_2SiO_4$:Mn is used for green and $BaMg_2Al_{14}O_{24}$:Eu is used for blue.

In this case, an electrode structure on the front plate of the plasma display panel of the present invention is distinctive. As shown in FIGS. 1A and 1B, on dielectric layer 26 provided on glass substrate 22, in order for floating electrode 34 to be electrostatically connected with first electrode 24, floating electrode 34 is arranged at a position corresponding to first electrode 24 in such a manner that floating electrode 34 protrudes onto the discharge space side. In the same manner, in order for floating electrode 35 to be electrostatically connected with second electrode 25, floating electrode 35 is arranged at a position corresponding to second electrode 25 in such a manner that floating electrode 35 protrudes onto the discharge space side. These floating electrodes 34, 35 are opposed to each other. Since these floating electrodes 34, 35 are floating, they are formed being electrically insulated from other electrodes. Protective film 36 are made of metallic oxide containing MgO and formed on these floating electrodes 34, 35. These floating electrodes 34, 35 may be made of material in which the surface can be assumed to be of the same electric potential. Therefore, it is preferable that at least a portion exposed onto the discharge space side and a boundary face with the dielectric layer are electrically conductive. Not only an electrical conductive body but also a dielectric body, the dielectric constant of which is high, can be applied to these floating electrodes. In this case, when the dielectric constant of the floating electrodes is sufficiently higher than that of material, which is used for a usual dielectric layer, it is possible to provide a good result.

A characteristic point of the present invention is described as follows. When an electric field is seldom formed inside the floating electrode that protrudes into the discharge space and the substantially same electric potential is impressed almost all over the surface, a distribution of the electric field (electric line of force) in the discharge space is changed. In order to realize this, it is possible to use material of a high dielectric constant, conductive material or material, at least the surface of which is electrically conductive.

In Embodiment 1 of the present invention, in order to make electric lines of force run in parallel with the substrate face from floating electrodes 34, 35 floating electrodes 34, 35 are used which are made of electrically conductive material such as metal. Examples of this electrically conductive material are: metallic electrode material such as Ag, Al, Ni, Pt Cr, Cu or Pd; transparent electrode material such as ITO; conductive ceramics such as carbide or nitride of various metals; and conductive material in which the above materials are combined with each other.

When floating electrodes 34, 35 are made to be electrically conductive electrodes, at the time of electrostatically combining first electrode 24 with second electrode 25, no electrical fields are formed inside floating electrodes 34, 35 and the same electric potential is given on the electrode surface, that is, no electric potential distribution is formed on the electrode surface. Accordingly, it is possible to curve a distribution of electric fields (electric lines of force), which are generated by first electrode 24 and second electrode 25, in a direction parallel with the substrate face (in the horizontal direction on the surface of the drawing) by floating electrodes 34, 35. Due to the foregoing, the electrode can be equivalently assumed to be an electrode, the dielectric constant of which is high, having no electric potential on the surface. Therefore, discharge 37 generated between the electrodes becomes an opposition discharge generated in a direction substantially perpendicular to the principal plane contributing to discharge of floating electrode and parallel with the substrate face. As a result, it is possible to suppress a loss of the loading particles and exciting particles at the time of discharge. Therefore, it is possible to reduce the discharge starting voltage.

As shown in the plan view of FIG. 1B, in each discharge cell, floating electrodes 34, 35 are a pair of isolated electrodes and respectively formed on dielectric layer 26 above first electrode 24 and second electrode 25 inside bulkhead 32.

When floating electrodes 34, 35 are provided being isolated in each discharge cell, no discharge electric current flows into the discharge cell from the adjoining discharge cell. That is, an electric current is limited by an electrostatic capacity formed by first electrode 24, second electrode 25, floating electrodes 34, 35 and dielectric layer 26 provided between them. Therefore, between floating electrodes 34, 35, an opposition discharge pulse can be stably generated, and, the discharge starting voltage of the discharge cell can be reduced and the light emission efficiency can be enhanced.

Further, floating electrodes 34, 35 are respectively arranged at positions right above first electrode 24 and second electrode 25. Due to the foregoing, floating electrodes 34, 35 are more strongly, electrostatically combined with first electrode 24 and second electrode 25. Since floating electrodes 34, 35 are arranged at positions right above first electrode 24 and second electrode 25 between which a long gap is formed, floating electrodes 34, 25 are formed into a pair of electrodes having the same long gap. Therefore, as a discharge cell having a long gap, the discharge cell can enhance the light emission efficiency while the discharge starting voltage is being reduced.

On the plasma display panel of the present invention, floating electrodes 34, 35 are composed so that the height at least from the surface of dielectric layer 26 can be in the range from 10% to 80% of the gap between first substrate 21 and second substrate 28 opposed to each other. When the height of floating electrodes 34, 35 is smaller than 10%, the discharge region comes close to the substrate surface. Therefore, it becomes difficult to conduct an opposition discharge and a reduction of the discharge starting voltage is obstructed. When the height of floating electrodes 34, 35 is larger than 80%, the discharge region collides with fluorescent material layer 33. Accordingly, there is a possibility that a surface of fluorescent material layer 33 is deteriorated.

As shown in FIGS. 1A and 1B, floating electrodes 34, 35 are respectively formed into a rectangular parallelopiped of narrow width which is substantially the same as the line width of first electrode 24 and second electrode 25. At least one each of floating electrode 34, 35 are arranged above first electrode 24 and second electrode 25 in such a manner that floating electrodes 34, 35 are opposed to each other. Since floating electrodes 34, 35 are respectively formed into a rectangular parallelopiped, a space inside the discharge cell can be put into practical use as an effective discharge space.

Examples of the method of providing floating electrodes 34, 35 above first electrode 24 and second electrode 25 of first substrate 21 which is a front plate are: a forming method in which electrode material paste is recoated by the printing method or the transferring method and baked; a method in which a film, on which isolated electrodes of a predetermined shape are formed, are transferred and attached to a portion on the substrate; and a method of using the photolithography technique or the lift-off method.

In PDP of Embodiment 1 of the invention, by a sub-field having an initializing period in which all display cells are put into the initialized state, also having a period of writing data in which each discharge cell is addressed and a display state corresponding to input data is selected and inputted into each cell and also having a maintaining discharge period in which a discharge cell in the displaying state is displayed by emitting light, one frame can be composed and driven by emitting light. In this drive step, when first electrode 24 and second electrode 25 are given a rectangular wave voltage, for example, of 230 to 250 V of the maintaining discharge voltage pulse so that the phase can be different from each other in this drive step, since floating electrodes 34, 35 are respectively electrostatically combined with first electrode 24 and second electrode 25, it is possible to obtain each maintaining discharge voltage from first electrode 24 and second electrode 25.

In the discharge cell in which the display state data has been written, between the sides of floating electrodes 34, 35 which are opposed to each other, pulse discharge is generated each time the voltage polarity is changed. Due to opposition discharge-like discharge generated between floating electrodes 34 and 35, a resonance line of 147 nm is emitted from excited xenon atoms in the discharge space, and a molecular beam of 173 nm is emitted from excited xenon molecules. Next, when the above ultraviolet irradiation is converted into visible irradiation by fluorescent material layer 33 on second substrate 28 which is a back plate, it is possible to obtain display light emission of PDP.

In the conventional surface discharge type discharge cell, electric energy inputted into the discharge space is determined by the scanning, the maintaining electrode width, the dielectric layer thickness and the maintaining voltage. In the discharge cell of the opposition discharge type of PDP of the present invention, electric energy inputted into the discharge space is determined by each electrostatic capacity between floating electrodes 34, 35 and first and second electrodes 24, 25. From the viewpoint of the drive circuit, it is equivalent that a condenser, which is composed between the electrode and the floating electrode, is inserted in series between the discharge cell and the discharge space. The above electrostatic capacity is changed by the width of the display electrode 23 and the thickness of the dielectric layer 26.

Electric lines of force generated in the discharge space are curved by floating electrodes 34, 35, which are floating, in a direction parallel with the substrate face. Since floating electrodes 34, 35 protrude into the discharge space, floating electrodes 34, 35 are substantially perpendicular to an angle formed between the electric lines of force and the floating electrode surface. As a result, a form of the maintaining discharge becomes an opposition discharge and the drive voltage can be reduced. Therefore, it is possible to conduct a drive of low electric current density, the efficiency of which is high.

Since a discharge generated between floating electrodes 34, 35 is an opposition discharge, the discharge efficiency can be enhanced and the light emission efficiency can be enhanced as compared with narrow gap PDP in which the conventional surface discharge is utilized. Since an opposition discharge is generated which is different from the conventional long gap type PDP, the discharge starting voltage can be reduced so as to reduce the maintaining discharge voltage. Therefore, the light emission efficiency can be enhanced and the electric power consumption can be reduced. Further, it is possible to prevent the fluorescent material layer from being deteriorated. As a result of reducing the maintaining discharge voltage, a peak value of the discharge electric current is reduced. Therefore, it is possible to make a uniform drive display on a large image plane. Further, since a quantity of spatter on the protective film is reduced, it is possible to enhance the reliability of the panel. Accordingly, it is possible to realize highly reliable PDP of high luminance coping with a highly fine large image plane.

On the plasma display panel of the present invention, first substrate 21 for PDP of a large image plane, the size of which is 65 inches, is formed as follows. Right above first electrode 24 and second electrode 25, the gap between which is formed at about 250 μm, floating electrodes 34, 35, which are electrically conductive electrodes made of Ag electrode material, were formed by the printing recoating method so that the electrode height (60 μm) can be 40% of the gap (150 μm) between the opposed substrates. As second substrate 28, third electrode 30, bulkhead 32 and fluorescent material layer 33 were formed. These first substrate 21 and second substrate 28 were arranged being opposed to each other. Then, Ne gas, in which Xe was mixed by 10%, was charged inside the space at 67 kPa. In this way, PDP was formed.

As a result, by the opposition discharge between floating electrodes 34, 35, which are arranged on first substrate 21 of the front face plate being opposed to each other, the discharge region was expanded larger than that of the conventional narrow gap type surface discharge type PDP. Therefore, the light emission efficiency was enhanced from 1.21 m/W to 2.41 m/W. At the same time, the luminance was enhanced by 1.6 times. With respect to the conventional long gap type PDP having the same gap of about 250 μm, it was conventionally necessary to impress a discharge starting voltage of 280 V to 300 V. However, in the case of the present embodiment, the discharge starting voltage was lowered by 20 to 50 V. The light emission efficiency was enhanced by 30% and the deterioration of the fluorescent material layer could be prevented. On the conventional long gap type panel, because of a high discharge maintaining voltage, a discharge electric current peak value of 1.5 mA/cell, which was high, was given. However, in the case of the embodiment, the discharge electric current peak value was lowered to 200 μA/cell. Therefore, even in the case of a large image plane of 65 inches, a large image plane drive display was made uniform and the protective film was not deteriorated. Therefore, it was possible to provide a highly reliable fine PDP of high luminance, the image plane of which was large. The electrode structure of the embodiment is simpler than that of the conventional surface direction opposition discharge type PDP. Therefore, it was possible to provide PDP of high luminance, the opening ratio of which was high, at low manufacturing cost.

In the above explanation, protective films 27, 36 containing MgO and others were formed so that protective films 27, 36 could cover surfaces of floating films 34, 35 and dielectric layer 26. However, the following structure may be adopted. The protective film is not provided on a surface of dielectric layer 26 coming into contact with the discharge space. At least on the side surfaces, which are opposed to each other, of floating electrodes 34, 35, protective film 36 having metallic oxide containing MgO is formed.

In the above embodiment, protective films 27, 36 are formed in steps which are different from each other. However, protective films may be formed so that the protective films can entirely cover surfaces of the dielectric layer and the floating electrodes.

Embodiment 2

Figure 2:
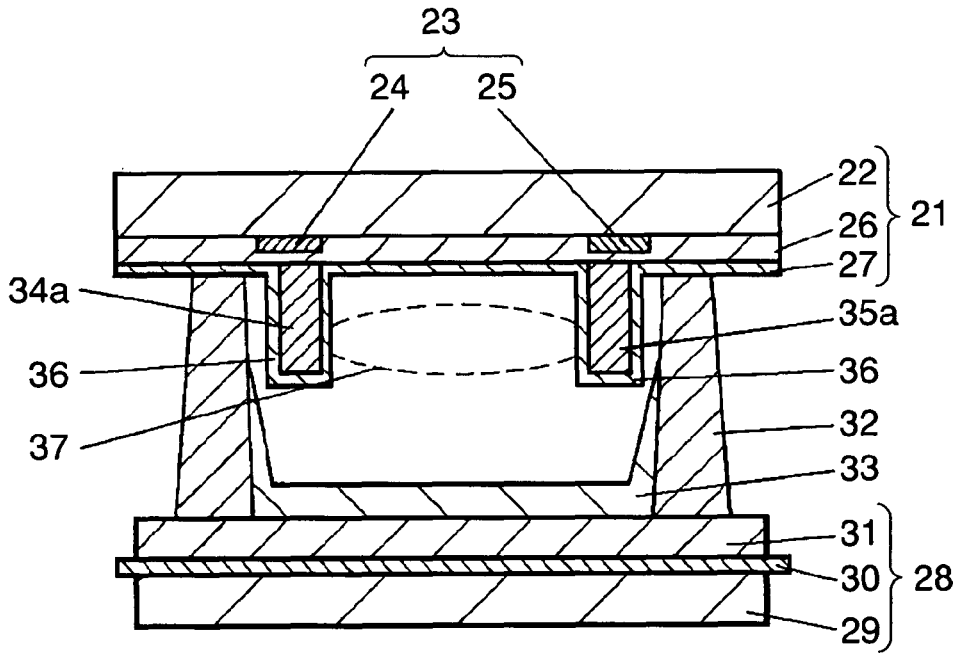
FIG. 2 is a sectional view showing a structure of a discharge cell on a plasma display panel of Embodiment 2 of the present invention.

FIG. 2 is a sectional view showing a structure of a discharge cell on a plasma display panel of Embodiment 2 of the present invention. Like reference numerals are used to indicate like parts in FIGS. 1A, 1B and FIG. 2.

FIG. 2 shows floating electrodes 34*a*, 35*a* made of dielectric material, the dielectric constant of which is high. Examples of the dielectric material, the dielectric constant of which is high, composing these floating electrodes 34*a*, 35*a* are $TaO_2$, $Y_2O_3$, $ZrO_2$, $HfO_2$ and $Bi_2O_3$. However, the dielectric material is not limited to the above specific materials. As long as it is a dielectric material, the dielectric constant of which is high, any material can be used.

It is desirable that the dielectric constant of dielectric material, the dielectric constant of which is high, composing floating electrodes 34*a*, 35*a* is twice as high as that of dielectric layer 26. Due to the foregoing, first electrode 24 and second electrode 25 can be more easily electrostatically combined with floating electrodes 34*a*, 35*a*. Therefore, it is possible to provide a discharge cell having discharge region 37 in which an excellent opposition discharge can be conducted. In this connection, the dielectric constant of dielectric layer 26 is about 10.

When floating electrodes are made to be dielectric electrodes, the dielectric constant of which is high, as described above, it is possible to form dielectric electrodes, on the surfaces of the floating electrodes of which an electric potential distribution seldom exists equivalently. Therefore, in the discharge cell, an opposition discharge is generated between floating electrodes in a substantially parallel direction with the substrate face. Accordingly, the discharge starting voltage is lowered and the light emission efficiency can be enhanced.

As another embodiment of Embodiment 2, floating electrodes 34*a*, 35*a* may be dielectric electrodes, the dielectric constant of which is high, in which at least electrical conductive material and dielectric material are mixed and dispersed with each other. Examples of the conductive material are: metallic fine particle material such as Ag, Al, Ni, Pt, Cr, Cu and Pd; fine particle electrode material such as ITO; conductive ceramics such as metallic carbide and metallic nitride; and fine particle conductive material in which these materials are combined with each other. Examples of the dielectric material are: fine particle dielectric material, the dielectric constant of which is low, such as $SiO_2$, $AlO_3$ or $SiN_4$; and fine particle dielectric material, the dielectric constant of which is high, such as $TaO_2$, $Y_2O_3$, $ZrO_2$, $HfO_2$ or $Bi_2O_3$. When material paste, in which at least conductive material and dielectric material are uniformly mixed and dispersed to each other, is coated and baked, floating electrodes can be formed.

When floating electrodes are made of material in which conductive material and dielectric material are uniformly mixed and dispersed to each other, the floating electrodes become dielectric electrodes, the dielectric constants of which are high. Therefore, a more excellent opposition discharge can be generated and the discharge starting voltage is further reduced and the light emission efficiency can be further enhanced. Since the dielectric electrodes, the dielectric constant of which are high, are made of material in which conductive material and dielectric material are uniformly mixed and dispersed to each other, the floating electrodes can be easily formed. Accordingly, it is possible to provide PDP of a low manufacturing cost.

Embodiment 3

Figure 3:
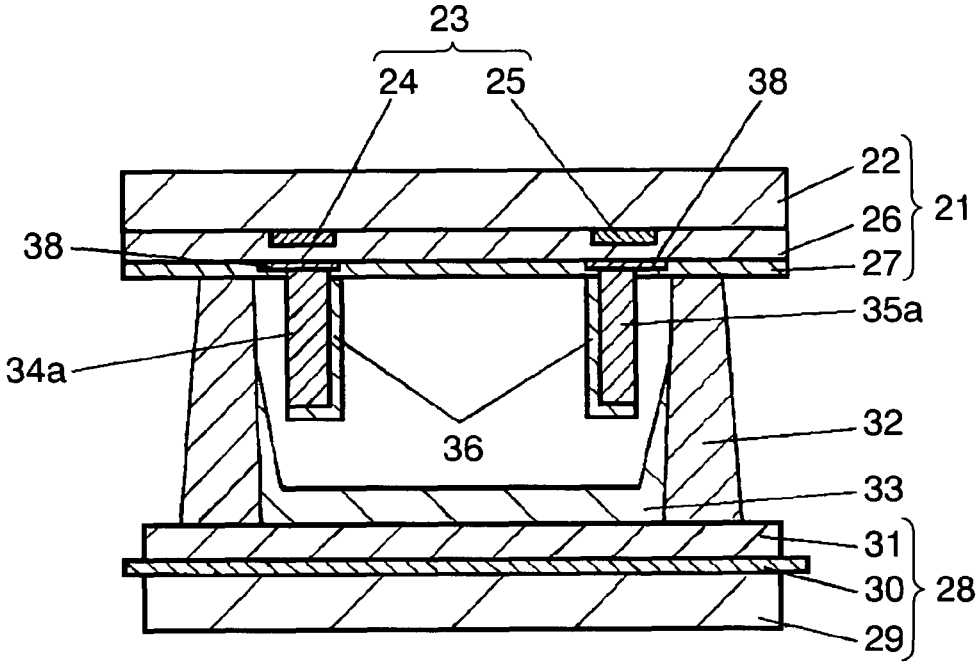
FIG. 3 is a sectional view showing a structure of a discharge cell on a plasma display panel of Embodiment 3 of the present invention.

FIG. 3 is a sectional view showing a structure of a discharge cell on a plasma display panel of Embodiment 3 of the present invention. Like reference numerals are used to indicate like parts in FIGS. 2 and 3.

In FIG. 3, electrical conductive portions 38, which are respectively formed out of a conductive film, are provided at least on boundary faces between floating electrodes 34*a*, 35*a*, which are high dielectric constant dielectric electrodes, and the dielectric layer. Widths of these electrical conductive portions 38 (widths in the horizontal direction on the surface of the drawing) are the same as areas of bottom portions of floating electrodes 34*a*, 35*a* formed on these electrical conductive portions 38. Alternatively, widths of these electrical conductive portions 38 may be larger than the bottom portions. Examples of these electrical conductive portions 38 are: metallic electrode material such as Ag, Al, Ni, Pt Cr, Cu or Pd; transparent electrode material such as ITO; conductive ceramics such as carbide or nitride of various metals; and conductive material in which the above materials are combined with each other. These electrical conductive portions are formed by patterning a conductive film made of the above materials.

When electrical conductive portions 38 are respectively provided at least on the boundary faces between floating electrodes 34*a*, 35*a*, which are high dielectric constant dielectric electrodes, and dielectric layer 26, first and second electrodes 24, 25 and floating electrodes 34*a*, 35*a* can be more strongly electrostatically combined with each other. Therefore, it is possible to supply a sufficiently high electric current. Further, an opposition discharge is more stably generated between the floating electrodes. Accordingly, the discharge starting voltage is further reduced and the light emission efficiency can be further enhanced.

In the example explained above, electrical conductive portions 38 are provided on the boundary faces between floating electrodes 34*a*, 35*a* and the dielectric layer 26. However, electrical conductive portions 38 may be formed on the opposed sides of floating electrodes 34*a*, 35*a* being continued from the boundary faces. Due to the foregoing, at least surfaces of floating electrodes 34*a*, 35*a* are electrically conductive. Therefore, between electrical conductive portions 38 and floating electrodes 34*a*, 35*a*, which are electrostatically combined with first and second electrodes 24, 25, an opposition discharge can be more easily generated.

Embodiment 4

Figure 4:
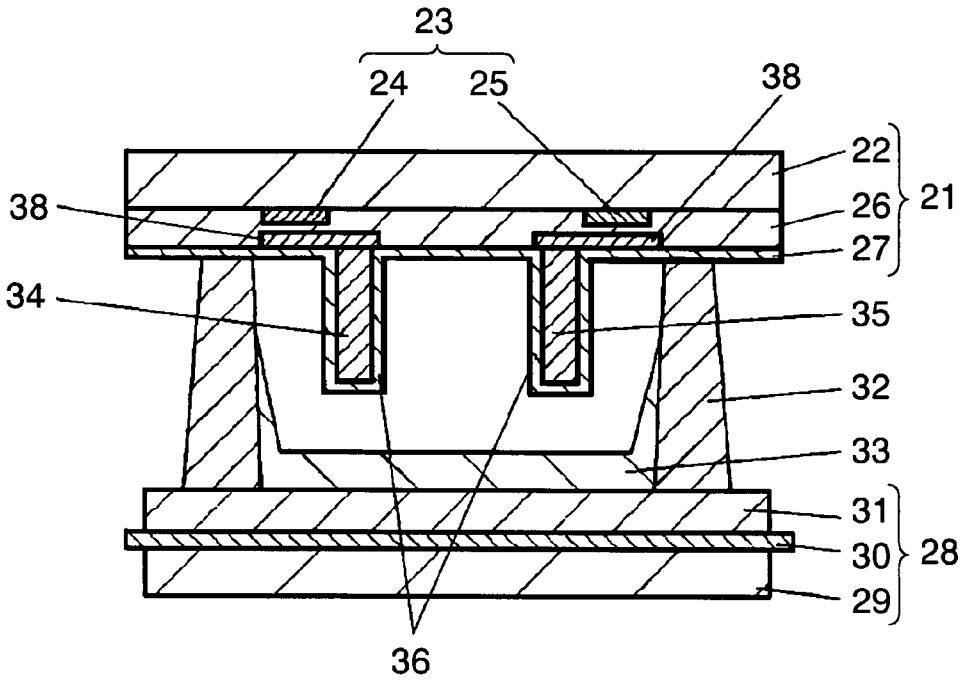
FIG. 4 is a sectional view showing a structure of a discharge cell on a plasma display panel of Embodiment 4 of the present invention.

FIG. 4 is a sectional view showing a structure of a discharge cell on a plasma display panel of Embodiment 4 of the present invention. Like reference numerals are used to indicate like parts in FIGS. 1A to 3.

As shown in FIG. 4, floating electrodes 34, 35 are respectively arranged at positions displaced from the positions right above first electrode 24 and second electrode 25. Further, electrical conductive portions 38 are provided between bottom portions of floating electrodes 34, 35 and dielectric layer 26. Further, areas of these electrical conductive portions 38 are larger than the bottom portions of floating electrodes 34, 35.

As shown in FIG. 4, since floating electrodes 34, 35 are respectively arranged at positions displaced from the positions right above first electrode 24 and second electrode 25, floating electrodes 34, 35 can be formed being separate from bulkheads 32. Therefore, floating electrodes 34, 35 can be easily formed.

Concerning the floating electrodes, floating electrodes 34*a*, 35*a* explained in Embodiment 2 may be used.

Embodiment 5

Figure 5:
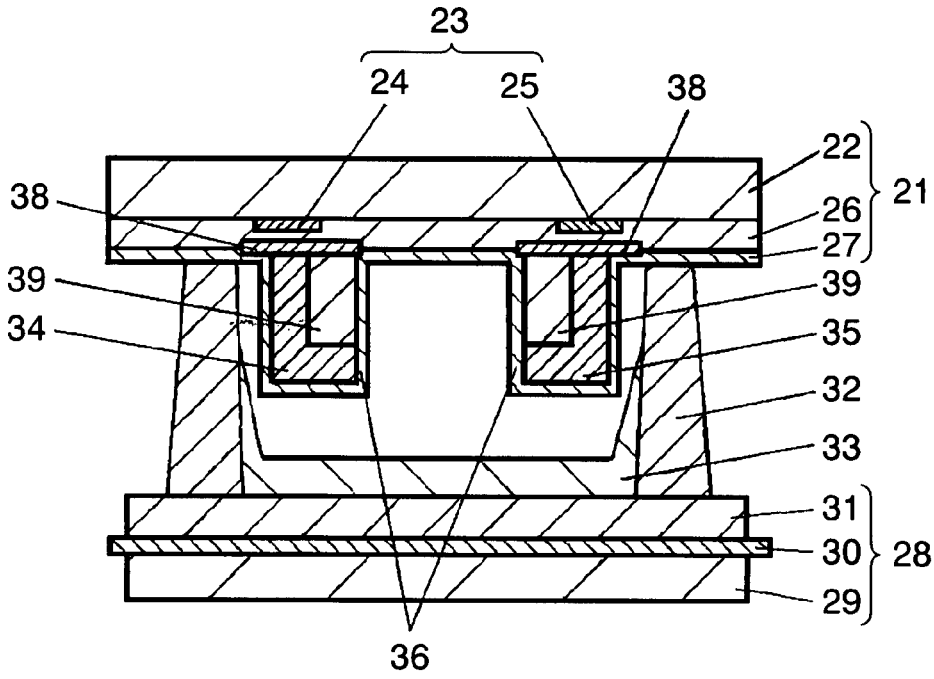
FIG. 5 is a sectional view showing a structure of a discharge cell on a plasma display panel of Embodiment 5 of the present invention.

FIG. 5 is a sectional view showing a structure of a discharge cell on a plasma display panel of Embodiment 5 of the present invention. Like reference numerals are used to indicate like parts in FIGS. 4 and 5.

Different points of FIG. 5 from FIG. 4 are described as follows. Dielectric portions 39 are provided at least one portion between floating electrodes 34, 35 and electrical conductive portion 38 being opposed to each other. Further, electrical conductive portions 38 are formed so that at least bottom portions of floating electrodes 34, 35 can be embedded in dielectric layer 26.

In the example shown in FIG. 5, floating electrodes 34, 35 are arranged in such a manner that floating electrodes 34, 35 come into contact with portions of electrical conductive portions 38 at positions right above first and second electrodes 24, 25 and cover dielectric portions 39. Electric potential of electrical conductive portion 38 and electric potential of forward end portions, which are opposed to each other, of floating electrodes 34, 35 covering dielectric portion 39 are the same. Accordingly, electric lines of force are emitted from the forward end portions of floating electrodes 34, 35 into the discharge space.

When at least the bottom portions of floating electrodes 34, 35 are embedded in dielectric layer 26, the bottom portions of floating electrodes 34, 35 can be made to come close to first electrode 24 and second electrode 25. Therefore, an electrostatic combination can be strengthened. Accordingly, an opposition discharge can be easily generated between the floating electrodes.

When dielectric portions 39 are arranged at least in portions of floating electrodes 34, 35 being opposed to each other, the opposition discharge can be generated at a deep position inside the discharge cell. Therefore, the discharge region can be separated from the substrate surface. Accordingly, it is possible to reduce a loss of the discharge efficiency on the substrate surface. It is possible to further reduce a discharge starting voltage and enhance the light emission efficiency.

Embodiment 6

Figure 6:
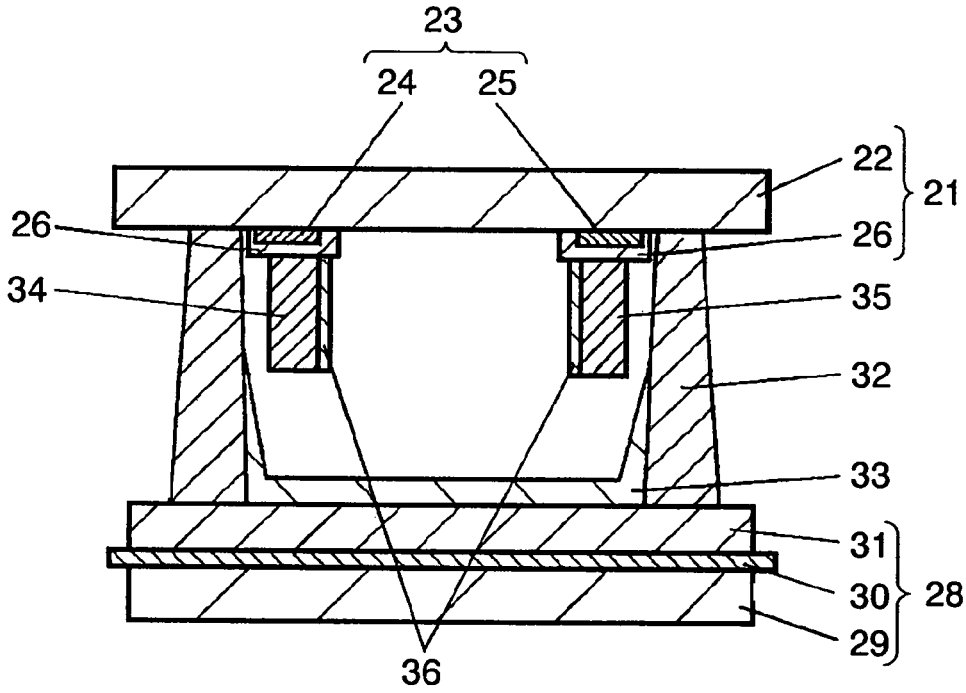
FIG. 6 is a sectional view showing a structure of a discharge cell on a plasma display panel of Embodiment 6 of the present invention.
Figure 7:
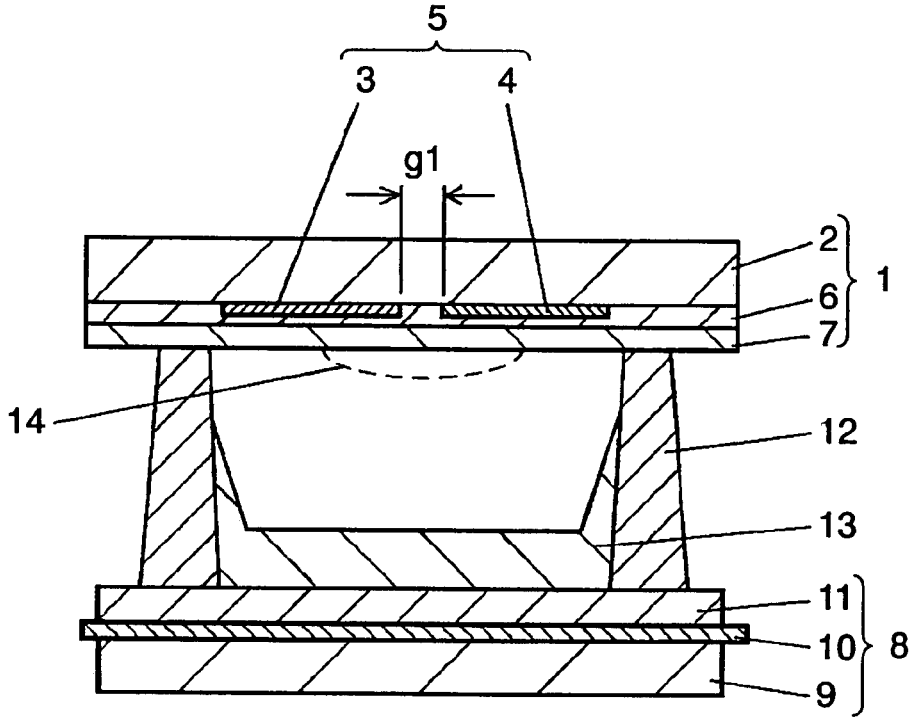
PRIOR ART FIG. 7
FIG. 7 is a sectional view showing a structure of a discharge cell on a conventional surface discharge type AC type plasma display panel.
Figure 8:
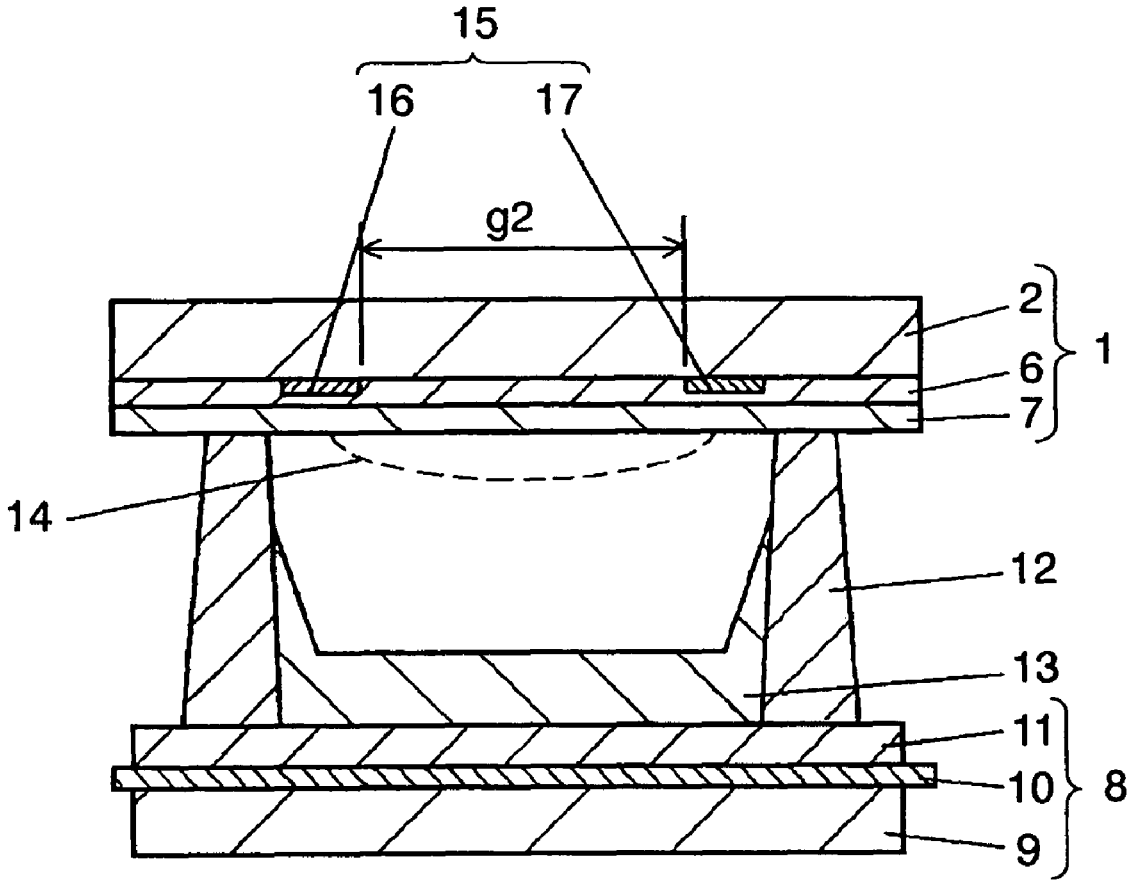
PRIOR ART FIG. 8
FIG. 8 is a sectional view showing a structure of another example of a discharge cell on a conventional surface discharge type AC type plasma display panel.

FIG. 6 is a sectional view showing a structure of a discharge cell on a plasma display panel of Embodiment 6 of the present invention. Like reference numerals are used to indicate like parts in FIGS. 1, 2 and 6.

Different points of FIG. 6 from FIGS. 1 and 2 are described as follows. Dielectric layer 26 is not formed between first electrode 24 and second electrode 25. Protective films 36 having metallic oxide containing MgO are formed at least on surface sides of floating electrodes 34, 35 which are opposed to each other.

As shown in FIG. 6, dielectric layers 26 are formed so that they can respectively cover surfaces of first electrode 24 and second electrode 25. In order for dielectric layer 26 not to be formed between first electrode 24 and second electrode 25, the following method may be adopted. At predetermined positions on first electrode 24 and second electrode 25 formed on glass substrate 22, for example, dielectric layer 26 and floating electrodes 34, 35 are laminated on each other. Then, a film, which has been separately formed, are transferred and attached. When dielectric layer 26 is not formed between first electrode 24 and second electrode 25 but respectively formed between first and second electrodes 24, 25 and floating electrodes 34, 35, an opposition discharge generated between floating electrodes 34, 35 is separate from the substrate surface. Therefore, the discharge starting voltage can be further reduced and the light emission efficiency can be enhanced.

Protective films 36 having metallic oxide containing MgO are formed at least on surface sides of floating electrodes 34, 35 which are opposed to each other. Therefore, it becomes possible to generate an opposition discharge between floating electrodes 34, 35 being more separate from the substrate face. Therefore, the discharge starting voltage can be further reduced and the light emission efficiency can be further enhanced.

As explained above, according to the plasma display panel of the present invention, when floating electrodes are arranged being protruded onto a discharge space side and opposed to each other, it is possible to expand a discharge region by a simple electrode composition while the discharge form is being formed into an opposition discharge form. Therefore, the discharge starting voltage can be reduced and the drive voltage can be lowered. Accordingly, the light emission efficiency can be enhanced.

In the above explanation, a shape of the floating electrode is formed into a rectangular parallelopiped. However, the shape of the floating electrode may be a cube, a columnar shape, a sphere, an arcuate column or a zigzag column. Further, a plurality of floating electrodes may be arranged.

In the above explanation, the floating electrode is formed into an electrical conductive electrode or a dielectric electrode of a high dielectric constant. However, when the floating electrode is formed so that visible light can transmit through the floating electrode by a method in which a surface of a dielectric body made of transparent silica is entirely covered with a transparent electrode such as ITO, the present invention can be executed in the same manner.

In the above explanation, the protective film is made of MgO. However, it is possible to use metallic oxide material containing at least one of MgO, CaO, BaO, SrO and ZnO. These materials may contain another material or impurities.

INDUSTRIAL APPLICABILITY

As described above, according to the present invention, the discharge region can be expanded. The discharge starting voltage can be reduced and the drive voltage can be also reduced. The light emission efficiency can be enhanced. Accordingly, the present invention is useful for obtaining highly reliable PDP of high luminance.

The invention claimed is:

1. A plasma display panel comprising:

a plurality of pairs of electrodes having a first electrode and a second electrode which are arranged in parallel with each other;

a first substrate having a dielectric layer formed so that the dielectric layer can cover the plurality of pairs of electrodes; and a second substrate having a third electrode which is arranged crossing the pairs of electrodes, wherein a plurality of discharge cells are provided when the first substrate and the second substrate are arranged being opposed to each other, and the plasma display panel further comprising:

floating electrodes protruding onto a discharge space side provided on the dielectric layer at positions respectively corresponding to the first electrode and the second electrode, wherein the floating electrodes are opposed to each other, wherein the floating electrodes are made of dielectric material, the dielectric constant of which is high, and wherein an electrical conductive portion is provided at least on a boundary surface between the floating electrodes and the dielectric layer.

2. The plasma display panel of claim 1, further comprising:

an electrical conductive portion formed between bottom portions of the floating electrodes and the dielectric layer, wherein an area of the electrical conductive portion is larger than the bottom portions of the floating electrodes.

3. The plasma display panel of claim 1, wherein the floating electrode is provided so that a dielectric portion can be opposed to at least a portion between the floating electrode and the electrical conductive portion.

4. The plasma display panel of claim 1, wherein the floating electrodes are formed so that they can be transmitted by visible light.

* * * * *